United States Patent [19]

Heh et al.

[11] Patent Number: 4,875,946

[45] Date of Patent: Oct. 24, 1989

[54] PROCESS FOR PRODUCING RARE EARTH-COBALT PERMANENT MAGNET

[75] Inventors: Shiang-Jiun Heh, Taipei; Swe-Kai Chen; Fu-Teh Jin, both of Kaohsiung; Li-Kou Chen, Taipei, all of Taiwan

[73] Assignee: Industrial Technology Research Institute, Chutung, Taiwan

[21] Appl. No.: 153,503

[22] Filed: Feb. 2, 1988

[51] Int. Cl.[4] ..... H01F 1/02

[52] U.S. Cl. ..... 148/103; 148/102; 148/104; 419/25; 419/29

[58] Field of Search ..... 148/103, 104, 102; 419/25, 29

[56] References Cited

U.S. PATENT DOCUMENTS

| | | | |
|---|---|---|---|
| 3,982,971 | 9/1976 | Yamanaka et al. | 148/104 |
| 4,221,613 | 9/1980 | Imaizumi et al. | 148/103 |

FOREIGN PATENT DOCUMENTS

| | | | |
|---|---|---|---|
| 56-17003 | 2/1981 | Japan | 148/104 |
| 60-36633 | 2/1985 | Japan | 419/25 |
| 0657912 | 4/1979 | U.S.S.R. | 148/104 |

*Primary Examiner*—John P. Sheehan

*Attorney, Agent, or Firm*—Ladas & Parry

[57] ABSTRACT

A heat-treatment process for producing rare earth-cobalt permanent magnets having relatively high and reproducible magnetic properties wherein one or more controlled cooling rates are applied in temperatures ranging from a sintering temperature and the isothermal annealing temperature. The controlled cooling rates are preferably divided into two steps. In the first step, the cooling rate is preferably greater than 10° C./min. In the second step, the cooling rate is preferably less than 10° C./min. and is ideally in the range of 2°–4° C./min. By the heat-treatment process of this invention, a permanent magnet having a high intrinsic coercivity of more than 20 kOe, a maximum energy product of greater than 19 MGOe, and a coercivity of greater than 8.1 kOe can be reproducibly obtained.

7 Claims, 4 Drawing Sheets

PROCESS FOR PRODUCING RARE EARTH-COBALT PERMANENT MAGNET

BACKGROUND OF THE INVENTION

1. Field of the Invention

This invention relates to a process for producing rare earth-cobalt ($RECo_5$) permanent magnets having a relatively high and stable intrinsic coercivity, and more particularly to a process for producing $(Sm_xPr_{1-x})Coy$ (wherein y is 4.6–5.0) in which varied cooling rates in the temperature range between a sintering proceeding and an isothermal annealing proceedings are rendered so as to significantly improve the magnetic properties of the magnets.

2. Description of the Prior Art

There has been a rapid development of $RECo_5$ permanent magnet materials since the 1970's. Among the known $RECo_5$ permanent magnets, it has been found that $NdCo_5$, $PrCo_5$ and $SmCo_5$ are in order, the top three $RECo_5$ permanent magnets in terms of saturation magnetization value; specifically, their values are 12.3 kG, 12.0 kG and 10.7 kG respectively. Therefore, the top three theoretical values of the maximum energy product of the known $RECo_5$ permanent magnets will also probably be those of $NdCo_5$, $PrCo_5$ and $SmCo_5$. The accuracy of the theoretical values of the maximum energy product is dependent on the normal coercivity of each of the permanent magnets. If the normal coercivity is less than a certain value. the theoretical values of the maximum energy product will not be accurate. In the meantime, the normal coercivity of the magnets will be decided by the crystal anisotropy field (Ha) of magnetic substances contained in each of the permanent magnets. The anisotropy fields of the $NdCo_5$, $PrCo_5$ and $SmCo_5$ are 30 kOe, 145 kOe and 290 kOe respectively. Accordingly, the real maximum energy product of $NdCo_5$ must be particularly less than the theoretical value thereof. On the other hand, the 10.7 kG value of the saturation magnetization renders the $SmCo_5$ magnet having a high value of residual magnetic flux density. The 290 kOe of the anostropy field renders the $SmCo_5$ magnet having a high coercivity and a high intrinsic coercivity. Thus, it may be said that the $SmCo_5$ magnet has the optimum magnetic properties among the known $RECo_5$ permanent magnets. However, due to the low supply of samarium in the earth, it is the expense that limits the application of the $SmCo_5$ magnet. It becomes a problem to be eagerly solved in the art.

Initially, some experiments were conducted on the $PrCo_5$ permanent magnet for two major reasons: (1) its saturation magnetization value is higher than that of the $SmCo_5$ alloy in the $RECo_5$ permanent magnets, and its anisotropy field half of that of the $SmCo_5$ alloy; and (2) the amount of praseodymium in the earth is about five times of that of samarium. Nevertheless, it was soon found that the residual magnetic flux density of the $PrCo_5$ alloy is higher than that of the $SmCo_5$ alloy, while the coercivity as well as the intrinsic coercivity of the former are much less than those of the later. That is to say, using a $PrCo_5$ permanent magnet to replace a $SmCo_5$ permanent magnet is very impractical.

In addition, some people in the art have tried to find ways to lessen the expense of samarium in $SmCo_5$ permanent magnets by using other light rare-earth elements, such as paraseodymium, as a substitute for part of the samarium as disclosed in Paper No. IV-4 at the 6th International Workshop on Rare-Earth Magnets and their Applications, Baden/Vienna, Austria, Aug. 31–Sept. 3, 1982 by M. Velicescu. However, owing to the unstable intrinsic coercivity of $(SmPr)Co_5$ magnets, the permanent magnet producers are hardly to get as low a quality loss of the respective magnets as possible in connection with reproducibility, that are comparable with that of $SmCo_5$ magnets.

Accordingly, it is the primary object of the present invention to provide a process by which a $(Sm_xPr_{1-x})$ Coy (wherein y is 4.6–5.0) magnet having a stable intrinsic coercivity can be obtained.

It is another object of the present invention to provide a process for producing $(Sm_xPr_{1-x})Coy$ (wherein y is 4.6–5.0) magnets having a relatively high intrinsic coercivity.

SUMMARY OF THE INVENTION

From the results of many experiments made by the inventors of the present invention, it has been found that in the heat treatment of the $(Sm_xPr_{1-x})$ Coy (wherein y is 4.6–5.0) alloy, controlling the cooling rates between a sintering temperature and an isothermal ageing temperature can significantly influence the stability of the coercivity and the intrinsic coercivity of the heat-treated $(Sm_xPr_{1-x})$ Coy (wherein y is 4.6–5.0) permanent magnet.

It is further appreciated that the optimum magnetic properties of the $(Sm_xPr_{1-x})$ Coy (wherein y is 4.6–5.0) alloy may be obtained if the cooling rates between the sintering temperature and the isothermal annealing temperature are devided into two stages, namely, a first stage between the sintering temperature and a temperature (Ta') which is 20° C. to 80° C. lower than the sintering temperature, in which a rapid cooling rate is used; and a second stage between the temperature (Ta') and the isothermal annealing temperature, in which a relatively slow cooling rate is used.

In accordance with the present invention a heat-treatment process wherein a $(Sm_xPr_{1-x})$ Coy (wherein y is 4.6–5.0) powder compacted in a magnetic field is sintered at a temperature between 1,000° C. and 1,200° C.; the sintered powder compact is cooled from the sintering temperature to a first cooling temperature in the range of about 920° C. to 1180° C. at a rate greater than 10° C./minute and then is immediately cooled from the first cooling temperature to a second cooling temperature which is in the range of about 870° C. to 930° C. at a rate no greater than 10° C./minute; the sintered powder compact is isothermally annealed at the end of the second cooling temperature; then the sintered powder compact is quickly cooled from the second cooling temperature or isothermal annealing temperature to room temperature at a rate greater than 40° C./minute; thereby a $(Sm_xPr_{1-x})$ Coy (wherein y is 4.6–5.0) permanent magnet having a residual magnetic flux density of at least 9,000 Gauss, an intrinsic coercivity of at least 15,000 Oersted, and a maximum energy product of at least $19.0\times10^6$ Gauss Oersted can be obtained.

The sintered alloy powder compact of the present invention may be cooled from said first cooling temperature to said second cooling temperature at a rate in the range of about 2° C. to 4° C./minute. The value of x of said alloy powder compound should be greater than 0.3 and less than or equal to 1. According to the present invention, while the molecular formula of said magnets is preferably $(Sm_{0.5}Pr_{0.5})$ $Co_{4.6}$, it is most preferably $(Sm_{0.67}Pr_{0.33})Co_{4.6}$. In addition, the alloy is sintered at a temperature in the range of about 1080° C. to 1140° C.

DETAILED DESCRIPTION OF THE INVENTION

Example 1

Figure 1:
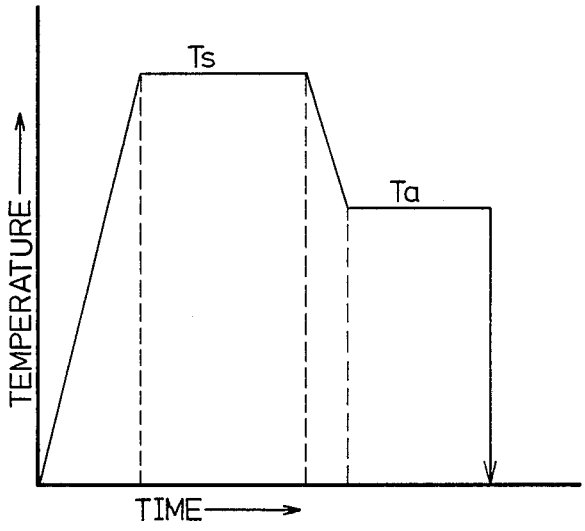
FIG. 1 shows a traditional heat-treatment of rare earth-cobalt permanent magnets.
Figure 2:
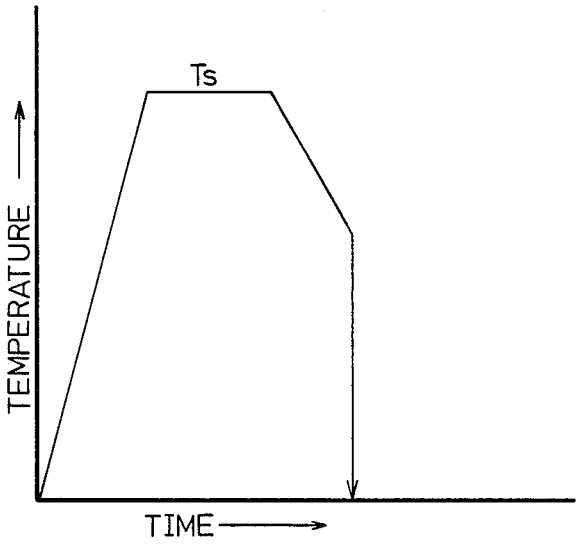
FIG. 2 shows a heat-treatment of rear earth-cobalt permanent magnets disclosed in U.S. Pat. No. 3,873,379.

A $(Sm_{0.5}Pr_{0.5})$ $Co_{4.6}$ alloy ingot was ground by a vibration ball mill to a 5 μm±1 μm powdery alloy. The obtained fine powderyy alloy was put into a metal die and then molded by compression in a horizontal magnetic field of 15 kOe so as to get a number of rod-shaped specimens having 14 mm in diameter. In accordance with the traditional heat-treatment shown in FIG. 1, the specimens were sintered under four combinations of sintering temperature (Ts) and isothermal annealing temperature (Ta) respectively. The magnetic properties of the sintered body are disclosed in Table 1.

TABLE 1

| Ts (°C.) | Ta (°C.) | D (g/cm³) | Br (kg) | Hc (kOe) | iHc (kOe) | (BH)max (MGOe) |
|---|---|---|---|---|---|---|
| 1130 | 900 | 8.27 | 9.2 | 7.4 | 9.6 | 19.4 |
| 1135 | 900 | 8.31 | 10.0 | 7.2 | 12.6 | 21.6 |
| 1135 | 950 | 8.23 | 9.2 | 6.4 | 8.6 | 19.2 |
| 1135 | 850 | 8.26 | 9.9 | 5.0 | 6.6 | 19.0 |

In Table 1, Ts is the sintering temperature, Ta is the isothermal ageing temperature, D is the density of the molded specimen, Br is the residual magnetic flux density, Hc is the coercivity, iHc is the intrinsic coercivity, and (BH)max is the maximum energy product. Although the density and maximum energy product can be obtained by the known processes, the values of the coercivity and of the intrinsic coercivity are relatively quite low and obviously unstable.

Example 2

Figure 3:
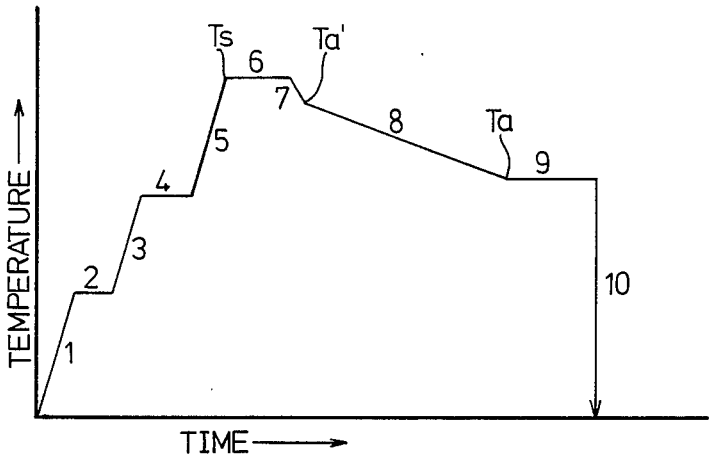
FIG. 3 shows an embodiment of the present invention, in which two-stage cooling rates are used.

A $(Sm_{0.67}Pro_{0.33})$ $Co_{4.6}$ alloy ingot was ground by a vibration ball mill to a 5±1 μm powder. The obtained powder was then put into a plastic mold. After being aligned in a pulse magnetic field of strength of 60 kOe, the powder compact was then pressed isostatically at 1800 kg/cm² to form a number of rod-shaped specimens having 14 mm diameter. The obtained specimens were treated using the process of the present invention shown in FIG. 3. In FIG. 3, the heating steps 1,2,3,4,5 and 10 are not features of this invention and are obvious skills in the heat-treatment of rare earth-cobalt permanent magnets, therefore, it will not be described in details hereinafter. The temperature in step 2 is 400° C.+50° C. and the temperature in step 4 is 850° C.+50° C. sintered specimen was kept in the isothermal annealing proceeding 9 for one to several hours and cooled at a rate greater than 40° C. per minute to 300° C. and then cooled to room temperature.

Figure 4:
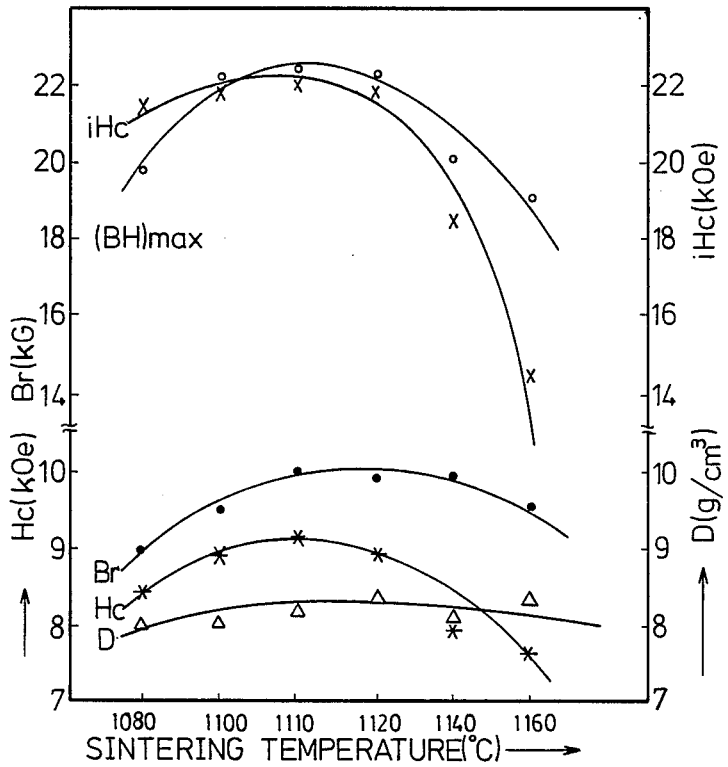
FIG. 4 shows the influence of the sintering temperature on the magnetic properties of $(Sm_{0.67}Pr_{0.33})$ $Co_{4.6}$ alloy.
Figure 5:
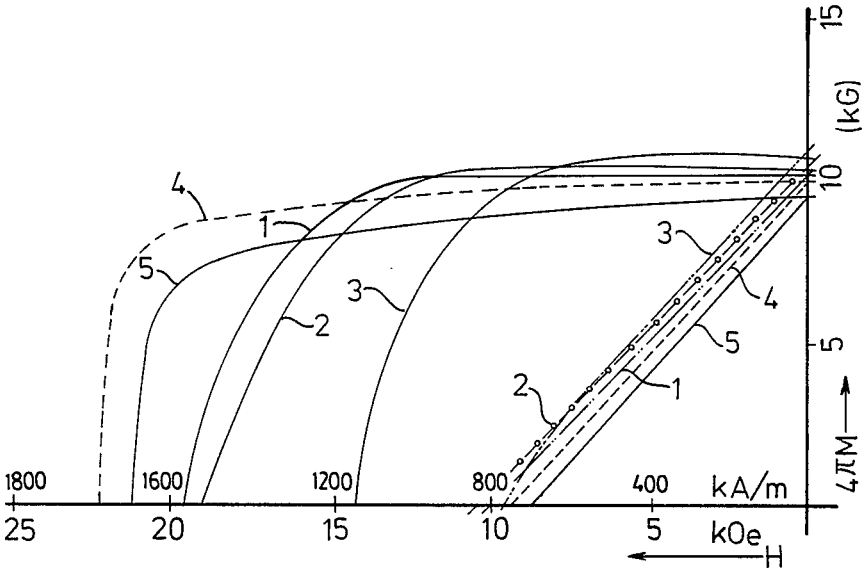
FIG. 5 shows a comparison of the demagnetizing curves of the $(Sm_{0.5}Pr_{0.5})$ $Co_{4.6}$ permanent magnets obtained by the conventional heat-treatment and those of the $(Sm_{0.5}Pr_{0.5})$ $Co_{4.6}$ permanent magnets obtained by the present invention.

Under six different combinations of sintering temperatures (Ts) and isothermal annealing temperatures (Ta), the heat treated specimens got the following magnetic properties shown in Table 2. FIGS. 4 and 5.

TABLE 2

| Ts (°C.) | Ta (°C.) | D (g/cm³) | Br (kg) | Hc (kOe) | iHc (kOe) | (BH)max (MGOe) |
|---|---|---|---|---|---|---|
| 1080 | 900 | 7.97 | 9.0 | 8.4 | 21.5 | 19.8 |
| 1100 | 900 | 8.15 | 9.5 | 8.9 | 21.9 | 22.3 |
| 1110 | 900 | 8.33 | 10.0 | 9.2 | 22.4 | 23.5 |
| 1120 | 900 | 8.43 | 9.8 | 8.9 | 21.8 | 22.6 |
| 1140 | 900 | 8.27 | 9.8 | 8.2 | 20.2 | 18.3 |
| 1160 | 900 | 8.42 | 9.5 | 7.6 | 14.4 | 19.2 |

In FIG. 5, the demagnetizing curves 1, 2, and 3 show the magnetic properties of the permanent magnets obtained by a known skill which is disclosed in the Mr. M Velicescu's paper, and the curves 4 and 5 show the magnetic properties of the permanent magnets obtained by the present invention.

When making a comparison between Example 1 and Example 2, it is easy to see that, due to the fact that the isostatic pressure was applied to the powdery alloy in a plastic mold as described above, even the praseodymium content of the alloy of Example 2 is lower than that of the alloy of Example 1, the residual magnetic flux densities (Br) of the magnets obtained from the two Examples are almost the same.

Furthermore, in Table 2, it is shown that when the sintering temperature (Ts) is in the range of 1080° C. 1120° C., the intrinsic coercivity iHc and the maximum energy product (BH)max of the sintered alloy obtained by the process of this invention shown in FIG. 3 are respectively no less than 21.5 kOe and 19.8 MGOe.

Example 3

A $(Sm_{0.67}Pr_{0.33})$ $Co_{4.6}$ alloy ingot was treated under the same conditions as described in Example 2 except that the powder compact was treated separately by different cooling rates between the sintering temperature (Ts) and the specific temperature (Ta') so as to get a better understanding of the influence of cooling rates on the intrinsic coercivity of the sintered magnets. The experimental results are disclosed in Table 3.

TABLE 3

| cooling rate (°C./min.) | iHc (kOe) |
|---|---|
| 2–4 | 21–22 |
| 6 | 19–20 |
| 10 | 18 |

From the data shown in Table 3 we may say that the slower the cooling rate, the higher the value of intrinsic coercivity.

Example 4

Figure 6:
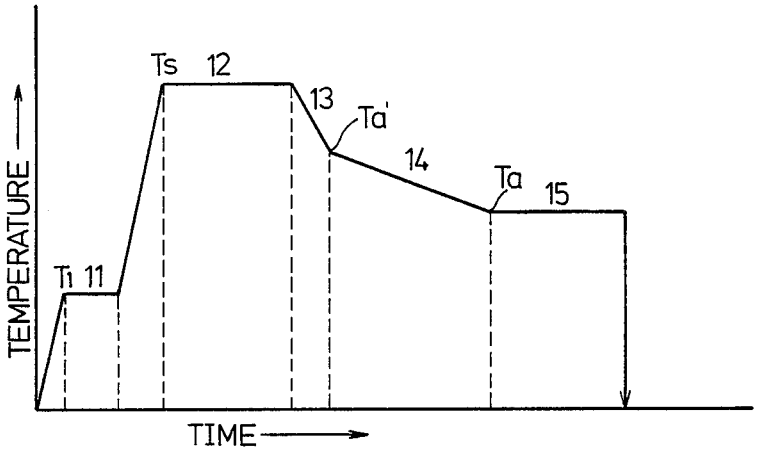
FIG. 6 shows another embodiment of this invention, which is preferably used for $SmCo_5$ magnet.

A reduction-difussion $SmCo_{4.7}$ powder, sized 5±1 μm, was put into a metal die and then molded by compression in a parallel magnetic field of 15 kOe so as to get pellet specimens having 14 mm in diameter and 10 mm thick. Such pellet specimens were treated by the process shown in FIG. 6, and magnets were then obtained with the magnetic properties shown in Table 4. In FIG. 6, the temperature of T1, Ts, Ta' and Ta were 450° C., 1158° C., 1050° C. and 880° C. respectively. And the time periods of steps 11, 12, 13, 14 and 15 were 10 minutes, 65 minutes, 10 minutes, 50 minutes and 90 minutes respectively.

TABLE 4

| Specimen Number | 1 | 2 | 3 | 4 | 5 |
|---|---|---|---|---|---|
| D (g/cm$^3$) | 8.2 | 8.2 | 8.2 | 8.17 | 8.06 |
| Br (kG) | 8.6 | 8.6 | 8.6 | 8.5 | 8.35 |
| Hc (kOe) | 8.4 | 8.3 | 8.4 | 8.35 | 8.25 |
| iHc (kOe) | >15 | >15 | >15 | >15 | >15 |
| (BH) max (MGOe) | 18.5 | 18 | 18 | 18 | 17.4 |

Figure 7:
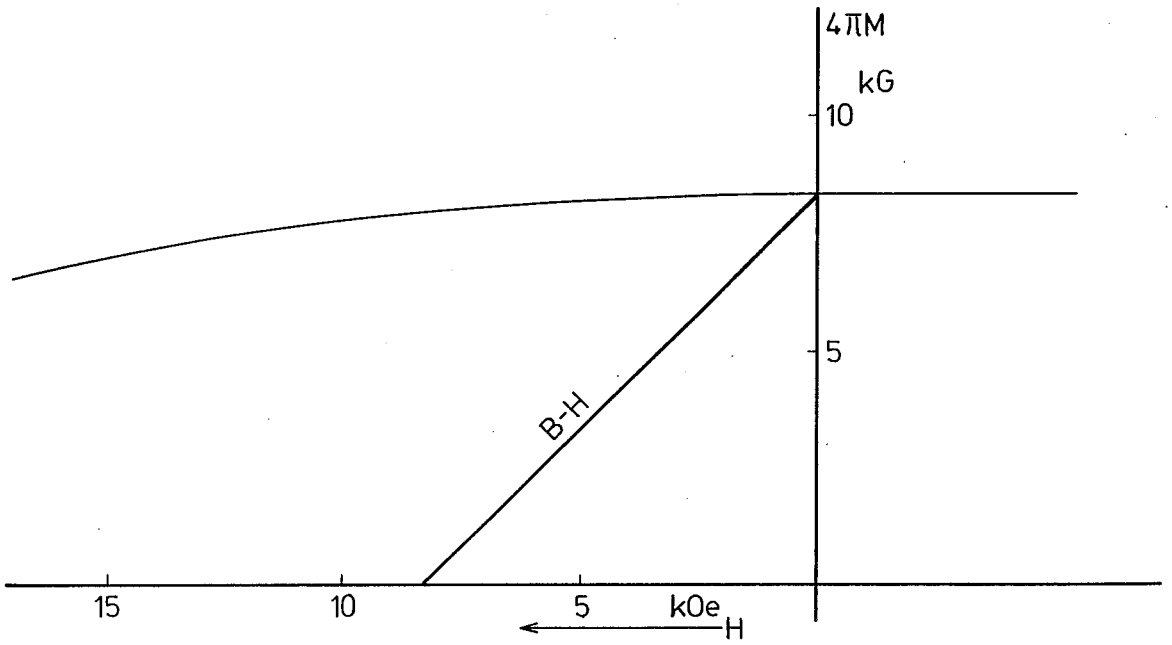
FIG. 7 shows a typical demagnetizing curve of $SmCo_{4.7}$ magnet obtained from Example 4.

In Table 4, it is also clearly shown that high value of intrinsic coercivity of more than 15 kOe was obtained by the process shown in FIG. 6 for the $SmCo_5$ magnet. The typical demagnitization curve of the $SmCo_5$ magnet is shown in FIG. 7.

As mentioned above in detail, the process of the present invention is characterized in that a sintered powdery alloy is cooled at various controlled rates from the sintering temperature to the isothermal annealing temperature.

What is claimed is:

1. A heat-treatment process for producing $(Sm_xPr_{1-x})$ Co permanent magnets having a remanence of at least 9000 Gauss, an intrinsic coercivity of at least 15,000 Oersted, and a maximum energy product of at least $19.0\times10^6$ Gauss Oersted comprising the steps of:

(1) compacting a $(Sm_xPr_{1-x})$ $Co_x$ powder, wherein y is from 4.6 to 5.0 and x is greater than 0.3 and less than or equal to 1, in a magnetic field; sintering said compacted powder at a temperature between 1000° C. and 1200° C. for thirty minutes to one hour;

(2) cooling said sintered alloy powder compact from said sintering temperature to a first cooling temperature in the range of about 920° C. to 1180° C. at a rate greater than 10° C./minute;

(3) cooling said sintered alloy powder compact immediately from said first cooling temperature to a second cooling temperature in the range of about 870° C. to 930° C. at a rate no greater than 10° C./minute;

(4) isothermally annealing said sintered alloy powder compact at said second cooling temperature for 1 to 10 hours;

(5) cooling said sintered alloy powder compact from said annealing temperature to a third cooling temperature in the range of about 280° C. to 320° C. at a rate greater than 40° C./minute; and (6) cooling said sintered alloy immediately from said third cooling temperature to room temperature as soon as possible.

2. A heat-treatment process for producing permanent magnets as claimed in claim 1, wherein said sintered alloy powder compact is cooled from said first cooling temperature to said second cooling temperature at a rate in the range of about 2° C. to 4° C./minute.

3. A heat-treatment process for producing permanent magnets as claimed in claim 1, wherein the molecular formula of said magnetis is $(Sm_{0.5}Pr_{0.5})$ $Co_{4.6}$.

4. A heat-treatment process for producing permanent magnets as claimed in claim 1, wherein the molecular formula of said magnets is $(Sm_{0.67}Pr_{0.33})$ $Co_{4.6}$.

5. A heat-treatment process for producing permanent magnets as claimed in claim 4, wherein said alloy is sintered at a temperature in the range of about 1080° C. to 1140° C.

6. A heat-treatment process for producing permanent magnets as claimed in claim 1, wherein the molecular formula of said magnets is $SmCo_{4.7}$.

7. A heat-treatmeant process for producing permanent magnets as claimed in claim 6, wherein said alloy powder compact is sintered at a temperature in the range of about 1100° C. to 1160° C.

* * * * *